United States Patent [19]

Wallot

[11] 4,238,711

[45] Dec. 9, 1980

[54] CIRCUIT FOR SELECTIVE INDIVIDUAL OPERATION OF MULTIPLE ARC DISCHARGE LAMPS

[75] Inventor: George P. Wallot, Fort Wayne, Ind.

[73] Assignee: General Electric Company, Fort Wayne, Ind.

[21] Appl. No.: 67,786

[22] Filed: Aug. 20, 1979

[51] Int. Cl.[3] ..... H05B 41/22; H05B 41/46

[52] U.S. Cl. ..... 315/324; 315/287; 315/289; 315/295; 315/313

[58] Field of Search ..... 315/88, 93, 287, 289, 315/294, 295, 311, 313, 323, 324, 362, DIG. 7

[56] References Cited

U.S. PATENT DOCUMENTS

| | | | |
|---|---|---|---|
| 2,859,387 | 11/1958 | Ulffers | 315/324 X |
| 3,365,648 | 1/1968 | Benjamin | 315/289 X |
| 4,132,925 | 1/1979 | Schmutzer et al. | 315/324 X |

*Primary Examiner*—Eugene R. LaRoche
*Attorney, Agent, or Firm*—Arthur E. Bahr

[57] ABSTRACT

A circuit including a switching regulator and a pair of pulse transformers for selectively starting and operating a pair of arc discharge lamps. The lamps are arranged to be connected in parallel across the regulator output, and in order to operate one lamp at a time, the circuit is provided with low-voltage switching means for selecting the lamp to be started and operated. This switching means, in the form of a ganged switch, includes a switch portion for completing an enable circuit from the regulator controller for enabling the regulator and a pulse generator, and a second switch portion for steering pulses from the generator to the pulse transformer associated with the lamp selected for operation.

11 Claims, 2 Drawing Figures

CIRCUIT FOR SELECTIVE INDIVIDUAL OPERATION OF MULTIPLE ARC DISCHARGE LAMPS

BACKGROUND OF THE INVENTION

1. Field of the Invention

The present invention relates to a circuit for starting and operating a plurality of arc discharge lamps, and more particularly, to an electrical circuit for starting and ballasting one lamp at a time of a plurality of arc discharge lamps, the circuit including means for selecting the individual lamp to be started and operated.

2. Description of the Prior Art

Many arc discharge lamp applications require a backup lamp. Circuits are provided, therefore, wherein multiple lamps share a single power supply. With such an arrangement, the lamps are operated individually, a single lamp being selected by a selector switch. This has been accomplished traditionally by connecting the lamps in parallel across the output of the power supply and opening the circuit to the lamps not intended to be lighted by the use of a relay contact connected serially with each lamp. This approach, although apparently simple, has several problems. They include these. (1) The relay contacts cannot be opened when the lamp is lighted because a generated DC arc is capable of melting the contacts before the arc breaks and is quenched. This problem is usually solved by adding a circuit which removes the input power to the power supply thus reducing output to zero before switching to the next lamp to be operated. (2) The open relay contacts associated with the unselected lamps are subjected to a high voltage stress level of 10 to 30 KV during lamp starting. This mandates the use of high-voltage power relays, and such relays are very expensive indeed. (3) Circuits required to operate these high-voltage power relays provide the "power down" function during switching and these high-voltage power relays themselves are often not capable of operating a sufficient number of "lamp switching cycles" to meet the needs of the application. In short, they are unreliable.

Furthermore, most prior art power supplies for operating arc discharge lamps have been of the "non-electronic" type; i.e., they are of the inductor, rectifier filter type. Such a circuit, having no inherent low-level electronic means to control the output as regards the "on" or "off" state, does not lend itself to a simple means of transferring the power supply output from one lamp to another.

It is desirable, therefore, to provide an electrical circuit for starting and ballasting a plurality of arc discharge lamps, the circuit being provided with means for transferring the output of the power supply from one lamp to another, thereby to effect selective individual operation of the lamps.

Accordingly, it is an object of the present invention to provide a circuit for the selective individual operation of multiple arc discharge lamps, the circuit including means capable of low-voltage operation while transferring circuit output from one lamp to another.

SUMMARY OF THE INVENTION

In accordance with the present invention, there is provided a circuit for selectively and individually starting and operating at least two arc discharge lamps connected in parallel. A regulator is included for providing regulated current for operating a selected one of the at least two lamps, the regulator including means for connection to a power source and further including a pair of output terminals for connection to the respective lamps. Means are provided for starting the at least two lamps, respectively, including at least two pulse transformers and a pulse generator for supplying pulses to the respective pulse transformers. One each of the pulse transformers is arranged for association with a corresponding one of the lamps. Means are also provided for selecting a one of the lamps to be started and operated. The selecting means are arranged for low-voltage operation and include means for enabling the regulator and the pulse generator and for steering the pulses from the pulse generator to a one of the pulse transformers associated with the one of the lamps selected for operation. The selecting means further includes means for disabling the pulse generator and the regulator for effecting turnoff of a previously lighted lamp and for resetting the circuit in preparation for starting a second of the lamps when the selecting means is operated to select the second of the lamps for operation.

In the preferred embodiment, the regulator is of the switching type for producing constant current regulated DC from a filtered DC voltage input.

DESCRIPTION OF THE PREFERRED EMBODIMENT

Figure 1:
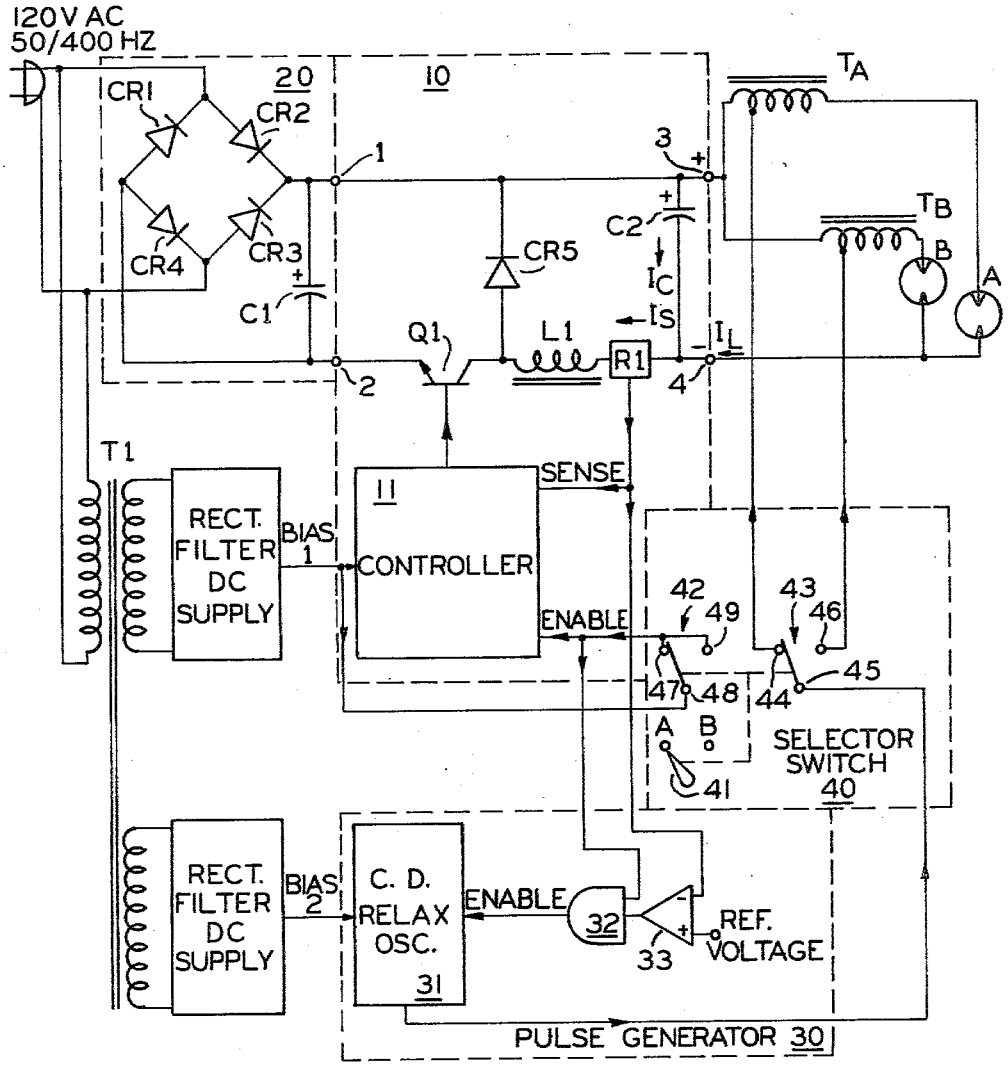
FIG. 1 shows by schematic representation the preferred embodiment of the circuit of the present invention.

In accordance with the present invention and referring now to FIG. 1, there is is shown the preferred embodiment of an electrical circuit for selectively and individually starting and operating at least two arc discharge lamps A and B connected in parallel. A regulator 10 is included for providing regulated current for operating a selected one of the at least two lamps. Regulator 10 is of the switching type for providing constant current regulated DC and includes means in the form of terminals 1 and 2 for connection to a power source filtered DC voltage source 20. Regulator 10 further includes a pair of output terminals 3 and 4 for connection to the respective lamps.

Means are provided for starting the at least two lamps, respectively, this including at least two pulse transformers $T_A$ and $T_B$ respectively arranged for association with the lamps A and B, respectively. As can be seen in FIG. 1, the pulse transformer $T_A$ is arranged for serial connection with the lamp A and pulse transformer $T_B$ is arranged for serial connection with lamp B across the output terminals 3 and 4. A pulse generator 30 is also provided for supplying pulses to the respective pulse transformers $T_A$ and $T_B$.

Means are also provided for selecting a one of the lamps to be started and operated, the selecting means being arranged for low-voltage operation and taking the form of a selector switch 40. Selector switch 40 is of the rotary, ganged type and includes a manually rotatable control knob 41, a first switch portion 42 serving as means for enabling regulator 10 and pulse generator 30, and a second switch portion 43 serving as means for steering the pulses from pulse generator 30 to the pulse transformer associated with the lamp selected for operation.

Operation of the circuit is as follows. Filtered DC voltage source 20 has as its input 120 VAC line voltage, 50 to 400 Hz. This line voltage is rectified by a bridge rectifier consisting of diodes CR1, CR2, CR3 and CR4 and is filtered by capacitor C1 to yield approximately 160 volts DC at terminals 1 and 2. Transformer $T_1$ isolates two outputs from the line voltage input and, through appropriate rectifier and filter networks, supplies DC bias voltages to switching regulator 10, pulse generator 30, and selector switch 40. Switching regulator 10 converts the voltage at terminals 1 and 2 to constant current regulated DC at terminals 3 and 4 during normal lamp operation when one of the lamps is ignited. At the moment before ignition, the 160 VDC is applied directly to the output terminals. Switching regulator 10 includes switching transistor Q1, free-wheeling diode CR5, storage inductor L1, output current sense resistor R1, output capacitor C2, and controller 11 responsive to output current sensed by current sense resistor R1.

Controller 11, when enabled, will drive switching transistor Q1 into saturation or turn it off, depending upon the magnitude and direction of change of current $I_s$ which flows through current sense resistor R1. Switching regulator 10 is enabled, that is, allowed to operate normally, when the enable signal output from bias 1 is allowed to complete a circuit back to the controller enable input. Should this path be broken, i.e., switch 42 be between contacts 47 and 49, switching transistor Q1 turns off resulting in the output voltage and current at terminals 3 and 4 going momentarily to zero. Should no lamp be lighted, current $I_s$ is equal to zero and transistor Q1 will be turned on. The full 160 volt DC input voltage will therefore appear at the output terminals 3 and 4 of switching regulator 10 and likewise across the lamps A and B.

The pulse generator 30 (enabled when controller 11 is enabled and the current as sensed by sensing resistor R1 is below a predetermined value) will then apply starting pulses to the primary winding of the selected pulse transformer by means of capacitive discharge, relaxation oscillator 31. The pulse transformer then will step up this pulse to 10 to 15 Kv. This high voltage pulse appears across the terminals of the selected lamp. Capacitor C2 bypasses the pulses across terminals 3 and 4, effectively placing the pulse transformer across the selected lamp, thereby resulting in ignition thereof. Current $I_L$ then rapidly increases through the lamp (current $I_s$ also increases) as the terminal voltage of the lamp decreases toward the run level (usually less than 50 volts DC). The pulse generator then stops pulsing as the sense voltage is always higher than the reference voltage input to low-current, reference comparator 33 at pulse generator 30.

Sense current $I_s$ (the sum of load current $I_L$ and output filter capacitor current $I_c$) is converted to a sense voltage by sense resistor R1. This sense voltage is sent to the controller 11 which switches Q1 on and off in a manner so that the load current $I_L$ is kept constant regardless of changes in line voltage or lamp run voltage. When transistor Q1 is on, current flows from the positive terminal of capacitor C1, through capacitor C2 and the selected pulse transformer and lamp, recombines as $I_s$ and returns to the negative terminal of capacitor C1 through resistor R1 and energy storage inductor L1. At a particular value of increasing current $I_s$, determined by the regulator controller 11, transistor Q1 is turned off, thus removing the load on capacitor C1. The energy stored in inductor L1 will then force current through free-wheeling rectifier CR5. Current $I_s$ will then decrease toward zero as long as transistor Q1 is off. At a predetermined value of decreasing current $I_s$, as determined by the regulator controller 11, transistor Q1 is turned on and the cycle repeats. If the enable circuit is open, transistor Q1 is turned off, instantly resulting in a rapid decrease to zero in lamp current. The selected lamp will then go out.

Lamps A and B are arc discharge type lamps which require starting pulse terminal voltages hundreds of times greater than operating or normal no-load output voltages. For this reason, it is possible to start either lamp without the other parallel lamp circuit conducting current. The use of separate start circuits consisting of pulse transformer $T_A$ in series with lamp A and pulse transformer $T_B$ in series with lamp B allows either lamp to be pulsed on from one enable-able, capacitor-discharge pulse generator 30. Assuming that control knob 41 of selector switch 40 is set for "Lamp A," the arm of switch portion 42 is closed to contact 47 thereby allowing the enabling signal to return to controller 11 for allowing turn-on of switching regulator 10, and allowing the enabling signal also to proceed to the pulse generator 30 for allowing turn-on thereof. Furthermore, the arm of switch portion 43 touches contact 44 (as shown). Pulses from pulse generator 30 (present when no lamp current flows through sense resistor R1 and the regulator 10 is enabled on) are thereby steered to pulse transformer $T_A$ to effect lighting of lamp A. Lamp A will be pulsed until it lights. Should it be desirable to switch to operation of the other lamp, control knob 41 of the selector switch 40 is moved to position "Lamp B." When the arm of switch 42 moves off the contact 47, which previously completed the enable circuit, the enable signal is broken to the pulse generator and the regulator 10. Sufficient time is afforded from when switch portion 42 leaves the contact 47 until it arrives at contact 49 for the lighted lamp to become extinguished. When switch portion 42 gets to contact 49, the power supply is re-enabled and proceeds to start lamp B in the same manner that lamp A was initially started.

Through the use of this low-voltage switching arrangement, a separate pulse transformer for each lamp and high speed electronic output enable features, the traditional high-voltage, high-current relay switching method of performing the task is avoided.

Figure 2:
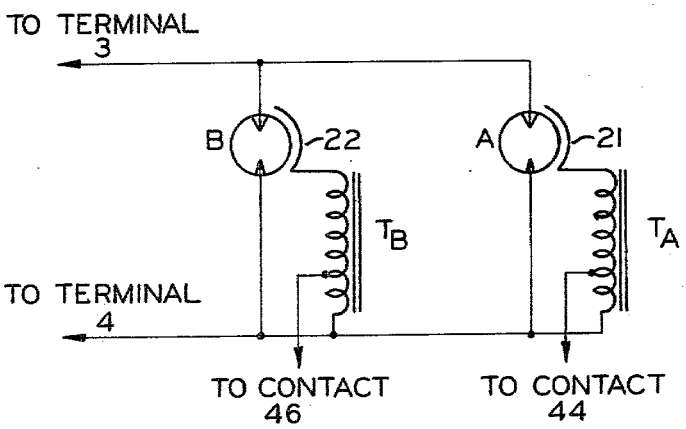
FIG. 2 shows, also by schematic representation, an alternate manner of connecting the pulse transformers for starting the lamps.

In FIG. 2 is shown an alternate arrangement of the lamps and pulse transformers. Should it be desired to start the respective lamps A and B through the use of starting aids (also referred to as trigger wires), the high-voltage outputs of the respective pulse transformers are connected to starting aids 21 and 22 associated with lamps A and B, respectively. Operation of the circuit is otherwise the same as in FIG. 1.

The circuit of FIG. 1 has been built and has operated satisfactorily with components having the following values and designations:

| | |
|---|---|
| Diodes | CR1, CR2, CR3, CR4; Bridge assy. EDI 5912<br>CR5; 1N3893 |
| Resistor | R1; .05 ohm. |
| Capacitor | C1; 430 uf 200V |

-continued

| | |
|---|---|
| | C2; 20 uf 250V |
| Transistor | Q1; 2N6062 |
| Inductor | L1; .57 mh |
| Pulse Transformers | $T_A$ and $T_B$; GE 9T68Y4063G61 |
| And Gate | 32; DC4081BE |
| Comparator | 33; LM2901N |
| Switch | 40; 2 section 2 position rotary switch |
| Lamps | A & B; GE MARC® 300 |

It should be understood that the circuit of the preferred embodiment can be easily expanded to include more lamps. Rather than a two position switch, a multiple position switch may be used to switch additional lamps into circuit.

It should be apparent to those skilled in the art that the embodiment described heretofore is considered to be the presently preferred form of the invention. In accordance with the patent statutes, changes may be made in the disclosed device and the manner in which it is used without actually departing from the true spirit and scope of the invention.

What is claimed is:

1. A circuit for selectively and individually starting and operating at least two arc discharge lamps connected in parallel, comprising:

a regulator for providing regulated current for operating a selected one of the at least two lamps; the regulator including means for connection to a power source and further including a pair of output terminals for connection to the respective lamps;

means for starting the at least two lamps, respectively, including at least two pulse transformers and a pulse generator for supplying pulses to the respective pulse transformers; one each of said pulse transformers arranged for association with a corresponding one of said lamps; and means for selecting a one of said lamps to be started and operated; the selecting means arranged for low voltage operation and including means for enabling the regulator and the pulse generator and for steering the pulses from the pulse generator to a one of said pulse transformers associated with the one of said lamps selected for operation; the selecting means further including means for disabling the pulse generator and the regulator for effecting turn-off of a previously lighted lamp and for resetting the circuit in preparation for starting a second of said lamps when the selecting means is operated to select the second of said lamps for operation.

2. The invention of claim 1 wherein the regulator has as its input filtered DC voltage from the power source, the regulator producing a current regulated DC output.

3. The invention of claim 2 wherein one each of the pulse transformers is arranged for serial connection with a corresponding one of said lamps across the output terminals.

4. The invention of claim 2 wherein at least two starting aids are provided for aiding in starting the lamps; one each of said starting aids being arranged for association with a corresponding one of said lamps, and one each of said pulse transformers is connected with a corresponding one of said starting aids.

5. The invention of claim 2 wherein the regulator is a switching regulator for providing constant current regulated DC.

6. The invention of claim 5 wherein operation of the pulse generator is conditioned upon switching regulator output current being below a predetermined value and upon an enabling signal being supplied to the pulse generator.

7. The invention of claim 5 wherein the switching regulator includes output current sensing means and a controller for regulating output current, the controller being responsive to output current sensed by the sensing means.

8. The invention of claim 7 further including means for producing an enabling signal to be supplied to the selecting means.

9. The invention of claim 8 wherein the selecting means includes a first switch, which when closed, allows the enabling signal to return to the controller thereby effecting turn-on of the switching regulator, and allows the enabling signal to proceed to the pulse generator thereby effecting turn-on of the pulse generator.

10. The invention of claim 9 wherein the selecting means includes a second switch operatively associated with the first switch, the second switch having multiple poles for steering the pulses from the pulse generator to the pulse transformer associated with the lamp selected for operation.

11. The invention of claim 10 wherein opening of the first switch provides adequate time for effecting extinguishing a previously lighted lamp before the circuit can be re-enabled to effect starting of another of the lamps.

* * * * *